US005417286A

United States Patent [19]

Palmer et al.

[11] Patent Number: 5,417,286

[45] Date of Patent: May 23, 1995

[54] METHOD FOR ENHANCING THE RECOVERY OF METHANE FROM A SOLID CARBONACEOUS SUBTERRANEAN FORMATION

[75] Inventors: Ian D. Palmer; Dan Yee, both of Tulsa, Okla.

[73] Assignee: Amoco Corporation, Chicago, Ill.

[21] Appl. No.: 174,303

[22] Filed: Dec. 29, 1993

[51] Int. Cl.[6] ..... E21B 43/26

[52] U.S. Cl. ..... 166/308; 166/305.1

[58] Field of Search ..... 166/250, 308, 305.1

[56] References Cited

U.S. PATENT DOCUMENTS

| | | | |
|---|---|---|---|
| 3,108,636 | 10/1963 | Peterson . | |
| 3,384,416 | 5/1968 | Ruehl et al. | 299/16 |
| 3,814,480 | 6/1974 | Dahl et al. | 299/2 |
| 4,245,699 | 1/1981 | Steeman | 166/271 |
| 4,283,089 | 8/1981 | Mazza et al. | 299/16 |
| 4,400,034 | 8/1982 | Chew | 299/5 |
| 4,446,921 | 5/1984 | Coenen et al. | 166/267 |
| 4,544,037 | 10/1985 | Terry | 166/369 |
| 4,913,237 | 4/1990 | Kutas | 166/308 |
| 5,014,788 | 5/1991 | Puri et al. | 166/308 |
| 5,142,111 | 9/1992 | Montgomery | 299/16 |

FOREIGN PATENT DOCUMENTS 609917 6/1978 U.S.S.R. .

OTHER PUBLICATIONS

R. S. Metcalf, D. Yee, J. P. Seidle, and R. Puri, "Review of Research Efforts in Coalbed Methane Recovery", SPE 23025 (1991).

A. V. Astakhov and D. L. Shirochin, "Capillary-Like Condensation of Sorbed Gases in Coals", *Fuel*, vol. 70, pp. 51-56 (Jan. 1991).

B. D. Hughes and T. L. Logan, "How to Design a Coalbed Methane Well", *Petroleum Engineer International*, pp. 16-20 (May 1990).

Carl L. Schuster, "Detection Within the Wellbore of Seismic Signals Created by Hydraulic Fracturing", SPE 7448 (1978).

Ralph W. Veach, Jr., Zissis A. Mosachovidis and C. Robert Fast, "An Overview of Hydraulic Fracturing", *Recent Advances in Hydraulic Fracturing*, vol. 12, Chapter 1, pp. 1-38, S.P.E. Monograph Series (1989).

N. R. Warpinski and Michael Berry Smith, "Rock Mechanics and Fracture Geometry," *Recent Advances in Hydraulic Fracturing*, vol. 12, Chapter 3, pp. 57-80, S.P.E. Monograph Series (1989).

Arfon H. Jones, et al., "A Review of the Physical and Mechanical Properties of Coal with Implications for Coal-Bed Methane Well Completion and Production", pp. 169-181, *Coal-Bed Methane*, a publication of the Rocky Mountain Association of Geologists (1988).

H. H. Abass et al., "Experimental Observations of Hydraulic Fracture Propagation Through Coal Blocks", SPE 21289 (Nov. 1990).

B. W. McDaniel, "Benefits and Problems of Minifrac Applications in Coalbed Methane Wells", pp. 103-1 through 103-16, Paper No. CIM/SPE 90-103, a publication of the Petroleum Society of CIM and the Society of Petroleum Engineers (1990).

T. L. Logan et al., "Optimizing and Evaluation of Open-Hole Cavity Completion Techniques for Coal Gas Wells", Proceedings of the 1993 International (List continued on next page.)

*Primary Examiner*—George A. Suchfield
*Attorney, Agent, or Firm*—Charles P. Wakefield; Richard A. Kretchmer

[57] ABSTRACT

A method for improving the recovery of methane from a solid carbonaceous subterranean formation penetrated by a wellbore, the method comprising the steps of introducing a first fluid into the formation which sorbs to the formation, allowing at least a portion of the first fluid to sorb to the formation, introducing a chemically different second fluid into the formation at a pressure higher than the parting pressure of the formation, relieving pressure within the formation to produce shear failure within the formation, and repeating the introduction of second fluid and the relieving of pressure until a desired permeability of the formation is obtained.

39 Claims, 2 Drawing Sheets

OTHER PUBLICATIONS

Coalbed Methane Symposium, The University of Alabama/Tuscaloosa, 9346, (May 1993).

S. D. Spafford et al., "Remedial Stimulation of Coalbed Methane Wells: A Case Study of Rock Creek Wells", Proceedings of the 1993 International Coalbed Methane Symposium, The University of Alabama/Tuscaloosa, 9374, (May 1993).

T. L. Logan et al., "Methane from Coal Seams Research", Quarterly Review of Methane from Coal Seam Technology, pp. 6–12, published by the Gas Research Institute, (Apr. 1993).

S. R. Daines, "Prediction of Fracture Pressures for Wildcat Wells", Journal of Petroleum Technology, pp. 863–872, (Apr. 1982).

I. D. Palmer et al., "Coalbed Methane Well Completions and Stimulations", Chapter 14, pp. 303–339, *Hydrocarbons from Coal,* published by the American Association of Petroleum Geologists (1993).

R. G. Jeffrey et al., "Small-Scale Hydraulic Fracturing and Mineback Experiments in Coal Seams", Proceedings of the 1993 International Coalbed Methane Symposium, The University of Alabama/Tuscaloosa, 9330, (May 1993).

H. Morales et al., "Analysis of Coalbed Hydraulic Fracturing Behavior in the Bowen Basin (Australia)", Proceedings of the 1993 International Coalbed Methane Symposium, The University of Alabama/Tuscaloosa, 9349, (May 1993).

I. D. Palmer et al., "Sandless Water Fracture Treatments in Warrior Basin Coalbeds", Proceedings of the 1993 International Coalbed Methane Symposium, The University of Alabama/Tuscaloosa, 9355, (May 1993).

S. D. Spafford et al., "Remedial Stimulation of Coalbed Methane Wells: A Case Study of Rock Creek Wells", Proceedings of the 1993 International Coalbed Methane Symposium, The University of Alabama/Tuscaloosa, 9374, (May 1993).

M. Khodaverdian et al., "Cavity Completions: A Study of Mechanisms and Applicability", Proceedings of the 1993 International Coalbed Methane Symposium, The University of Alabama/Tuscaloosa, 9336, (May 1993).

S. W. Lambert et al., "Warrior Basin Drilling, Stimulation Covered", *Oil & Gas Journal,* pp. 87–92, (Nov. 13, 1989).

T. L. Logan et al., "Hydraulic Fracture Stimulation and Openhole Testing of a Deeply Buried Coal Seam in the Piceance Basin, Colorado", Society of Petroleum Engineers, SPE 15251 (1986).

I. D. Palmer et al., "Openhole Cavity Completions in Coalbed Methane Wells in the San Juan Basin", Society of Petroleum Engineers, SPE 24906, (1992).

I. D. Palmer, "Review of Coalbed Methane Well Stimulation", Society of Petroleum Engineers, SPE 22395, (1992).

METHOD FOR ENHANCING THE RECOVERY OF METHANE FROM A SOLID CARBONACEOUS SUBTERRANEAN FORMATION

FIELD OF THE INVENTION

This invention is directed to methods for increasing the rate of recovery of methane from a solid carbonaceous subterranean formation, and more specifically, to methods which increase the rate of recovery by increasing the permeability of the formation.

BACKGROUND OF THE INVENTION

Solid carbonaceous subterranean formations contain significant quantities of natural gas. This natural gas is composed primarily of methane. The majority of the methane is sorbed onto the carbonaceous matrix of the formation and must be desorbed from the matrix and transferred to a wellbore in order to be recovered. The rate of recovery at the wellbore typically depends on the gas flow rate through the solid carbonaceous subterranean formation. The gas flow rate through a solid carbonaceous subterranean formation is affected by many factors including the matrix porosity of the formation, the system of fractures within the formation, and the stress within the carbonaceous matrix which comprises the solid carbonaceous subterranean formation.

An unstimulated solid carbonaceous subterranean formation has a natural system of fractures, the smaller and most common ones being referred to as "cleats" or collectively as a "cleat system". To reach the wellbore, the methane must desorb from a sorption site within the matrix and diffuse through the matrix to the cleat system. The gas then passes through the cleat system to the wellbore.

The cleat system communicating with a production well often does not provide for an acceptable methane recovery rate. In general, solid carbonaceous subterranean formations require stimulation to enhance the recovery of methane from the formation. Various techniques have been developed to stimulate solid carbonaceous subterranean formations and thereby enhance the rate of recovery of methane from these formations. These techniques typically attempt to enhance the desorption of methane from the carbonaceous matrix of the formation and/or to enhance the permeability of the formation.

One example of a technique for stimulating the production of methane from a solid carbonaceous subterranean formation is to complete the production wellbore with an open-hole cavity. First, a wellbore is drilled to a location above the solid carbonaceous subterranean formation. The wellbore is cased and the casing is cemented in place using a conventional drilling rig. A modified drilling rig is then used to drill an "open-hole" interval within the formation. An open-hole interval is an interval within the solid carbonaceous subterranean formation which has no casing set. A metal liner, which has holes, may be placed in the open-hole interval if desired. The open-hole interval can be completed by various methods. One method utilizes an injection/-blowdown cycle to create a cavity within the open-hole interval. In this method, air is injected into the open-hole interval and then released rapidly through a surface valve. The procedure is repeated until a suitable cavity has been created. During the procedure, a small amount of water can be added to selected air injections to reduce-the potential for spontaneous combustion of the carbonaceous material of the formation.

A limitation of this technique is that its effectiveness in efficiently increasing methane recovery is mainly limited to formations where formation pressure and permeability are high, such as in the "fairway" zone of the San Juan Basin located in northern New Mexico and southwestern Colorado.

Gel and foam fracture treatments are examples of other types of stimulation techniques which have been used to increase the methane recovery rate from a formation. These stimulations typically are conducted in formations where the region of the wellbore penetrating the solid carbonaceous subterranean formation is completed with a cased hole technique, a so-called cased-hole interval. With a cased-hole interval, the region of the wellbore penetrating the solid carbonaceous subterranean formation is cased and the casing is cemented in place using conventional techniques. The stimulations use of a high viscosity fluid, such as gels or foams, will assist in transporting proppant, if utilized, into the formation. The proppant is injected into the formation through perforations formed in the casing adjacent the formation. The high viscosity fluids are injected at pressures above the parting pressure of the formation. The injection of fluid at pressures above parting pressure induces a new dominant fracture, or fracture system, which is intended to better connect the formation to a production well. The injection is continued for the desired length of time and then ceased. The fluid preferably carries a proppant to hold the fractures open once the injection pressure is released. In general, the injection of the fluid is not repeated.

Unfortunately, gel and foam fracture techniques often result in damage to the formation due to the interactions between the high viscosity fluid and the formation matrix. Additionally, conventional fracture techniques mainly create tensile fractures within the formation and do not cause substantial shear failure within the formation. It is believed by the inventors of the present invention that the creation of shear failure within the formation is important for enhancing the recovery of methane from a formation. Because conventional fracture techniques do not cause significant shear failure within the formation, they do not significantly reduce the stress within the formation. In fact, if proppants are utilized with conventional fracture techniques, the proppants often increase the stress within the carbonaceous matrix. This increase in stress can reduce the recovery of methane from the formation by compressing the cleats and reducing the permeability of the formation.

A third stimulation technique which has been utilized to enhance the methane recovery rate from a formation is water fracture treatments. Like gel fracture treatments, this technique is typically utilized in formations in which the wellbore interval penetrating the formation is completed with a cased-hole technique. The treatments typically are conducted through perforations in the casing adjacent the formation. The water is injected at a pressure above the formation parting pressure of the formation, inducing a new dominant fracture, or fracture system, which is intended to better connect the formation to a production well. The technique optionally utilizes proppants to hold the fractures open. Like gel fracture treatments, conventional water fracture treatments generally do not cause substantial shear failure within the formation.

Puri et al., U.S. Pat. No. 5,014,788, discloses a method for increasing the permeability of a coal seam by introducing a fluid into the coal seam which causes the coal to swell. The pressurized fluid is maintained within the seam to enhance the contact between the fluid and the coal seam. The pressure within the seam is relieved by allowing the fluid to flow out the wellbore prior to the pressure within the coal seam decreasing to a stabilized pressure. The method of the patent is intended to increase the permeability of a coal seam located near the wellbore. The patent teaches that the procedure may be repeated but it does not disclose how many times to repeat the procedure or how to determine how many repetitions are to be performed.

What is needed is a method for stimulating a solid carbonaceous subterranean formation to increase the rate of methane recovery from the formation which enables various fluids to be used to stimulate the formation while minimizing the damage to the permeability of the formation.

SUMMARY OF THE INVENTION

The present invention is a method for increasing the rate of recovery of methane from a solid carbonaceous subterranean formation, the method comprising:

a) introducing a first fluid into the solid carbonaceous subterranean formation which sorbs to the solid carbonaceous subterranean formation;

b) allowing at least a portion of the first fluid to sorb to the solid carbonaceous subterranean formation;

c) introducing a chemically different second fluid into the solid carbonaceous subterranean formation at a pressure higher than the parting pressure of the solid carbonaceous subterranean formation;

d) relieving pressure within the solid carbonaceous subterranean formation to produce shear failure within the solid carbonaceous subterranean formation; and e) repeating steps c) through d) until a desired permeability of the solid carbonaceous subterranean formation is obtained.

In a second embodiment of the invention, a method is disclosed for improving the recovery of methane from a solid carbonaceous subterranean formation penetrated by a wellbore, the method comprising the steps of:

a) introducing a fluid into the solid carbonaceous subterranean formation which sorbs to the solid carbonaceous subterranean formation at a pressure above the parting pressure of the formation;

b) relieving pressure within the solid carbonaceous subterranean formation to produce shear failure within the solid carbonaceous subterranean format-:ion; and c) repeating steps a) through b) until a rate of change of the parting pressure from cycle; to subsequent cycle does not economically justify further stimulation of the formation.

In a third embodiment of the invention, a method is disclosed for improving the recovery of methane from a solid carbonaceous subterranean formation penetrated by a wellbore having wellbore control equipment, capable of regulating the rate of fluid flow from the wellbore, the method comprising the steps of:

a) introducing a fluid into the solid carbonaceous subterranean formation which sorbs to the solid carbonaceous subterranean formation at a pressure above the parting pressure of the formation;

b) relieving pressure within the solid carbonaceous subterranean formation to produce shear failure within the solid carbonaceous subterranean formation; and c) repeating steps a) through b) until a rate of change of the apparent closure pressure from cycle to subsequent cycle does not economically justify further stimulation of the formation.

As used herein, the following terms have the following meanings:

(a) "formation parting pressure" and "parting pressure" mean the pressure needed to open a formation and propagate an induced fracture through the formation.

(b) "closure pressure" is the pressure at which an induced fracture closes. Both the parting pressure and the closure pressure of a formation can change during the application of the invention to the formation.

(c) "solid carbonaceous subterranean formation" refers to any substantially solid, methane-containing material located below the surface of the earth. It is believed that these solid, methane-containing materials are produced by the thermal and biogenic degradation of organic matter. Solid carbonaceous subterranean formations include but are not limited to coalbeds and other carbonaceous formations such as some shales.

The present invention causes substantial shear failure within the formation and offers an improved method for stimulating a solid carbonaceous subterranean formation to increase the recovery of methane from production wells that penetrate the formation and are completed using either "cased-hole" or "open-hole" completion techniques. Also, the invention is effective in new wells or as a workover technique for older wells.

The embodiments of the invention which utilize a first and second fluid provide advantages that are not readily attainable by using a single fluid. For example, the first fluid protects the carbonaceous matrix from second fluids which may damage the matrix. For the purposes of this invention, a "carbonaceous matrix" includes both a carbonaceous material and the natural system of fractures located within the material. Also, if a cold fluid is used for either the first or second fluid, thermoelastic stresses will be created within the formation which enhance the failure of the matrix.

In another aspect of the invention a method is provided for conducting an optimum stimulation technique so that time and expenses are not wasted in the stimulation of the formation.

DETAILED DESCRIPTION OF THE INVENTION

Figure 1:
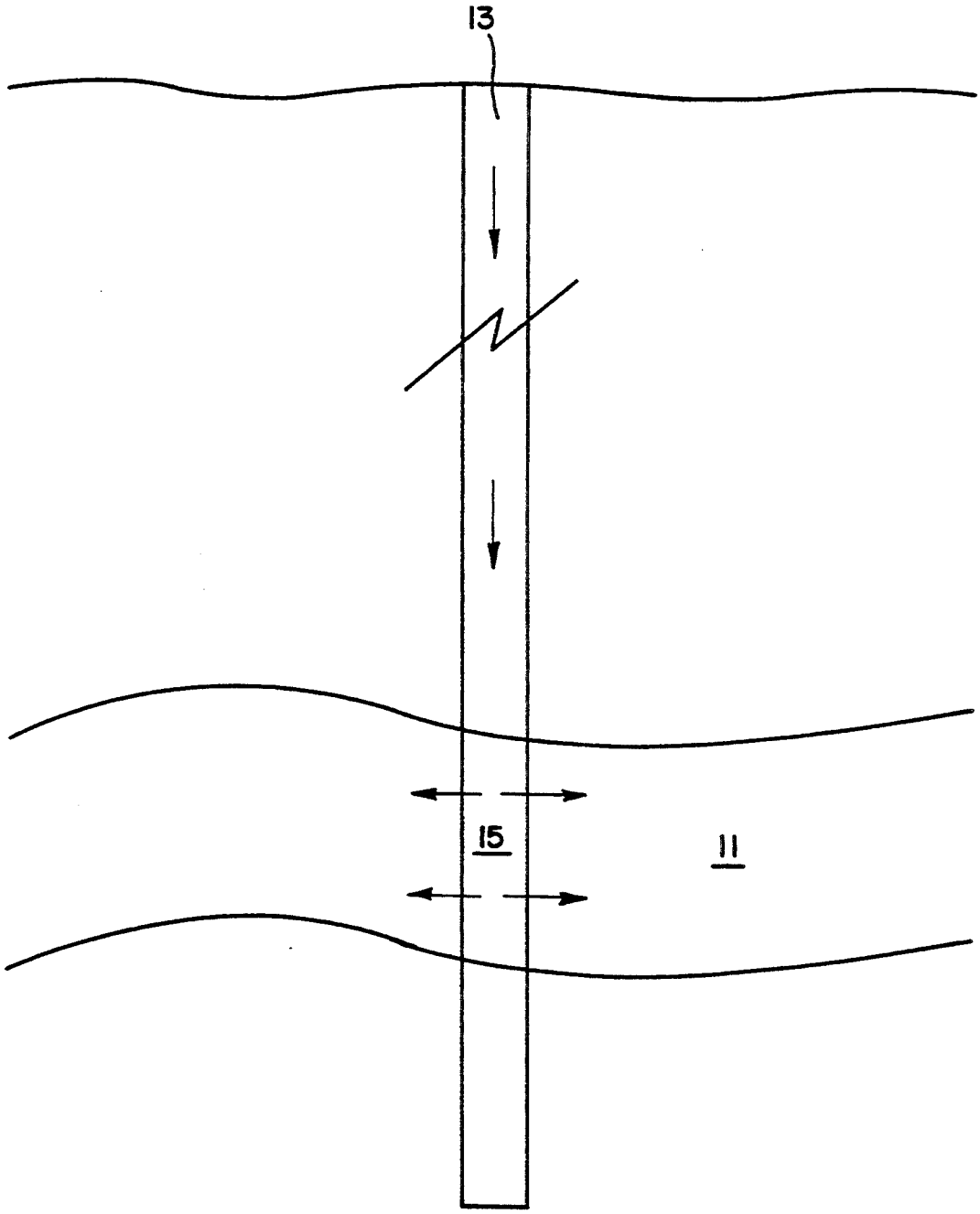
FIG. 1 is a diagrammatical elevational view of a wellbore penetrating a solid carbonaceous subterranean formation.

The invention is a method of increasing the rate of recovery of methane from a solid carbonaceous subterranean formation. The method involves introducing into the solid carbonaceous subterranean formation a first fluid which sorbs to the carbonaceous matrix of the solid carbonaceous subterranean formation. An example of a suitable first fluid is carbon dioxide. The first fluid is maintained in the formation to allow it to sorb to the carbonaceous matrix of the formation. Complete sorption of the first fluid is not required. A second fluid subsequently is introduced into the solid carbonaceous subterranean formation by injecting it through a wellbore at a pressure higher than the parting pressure of the formation. The injection of the second fluid at a pressure higher than parting pressure creates a new dominant tensile fracture or fracture system within the formation. This may be accomplished by further opening and extending preexisting fractures within the formation or by creating new fractures within the formation. Preferably, the second fluid is introduced rapidly into the formation to enhance the fracturing of the formation.

Once the desired amount of second fluid has been injected, the pressure within the formation is rapidly relieved through the wellbore. This rapid relief of the pressure is called "blowdown". Shear failure will occur within the carbonaceous matrix during blowdown due to the rapid relief of pressure within the formation. Factors, such as, the release of pressure within the formation, the drag forces exerted on the carbonaceous matrix as the pressure is relieved, and the physical changes, as discussed below, which result from the introduction of a first and a second fluid into the formation all enhance the shear failure within the formation.

The injection of the second fluid and the blowdown of the wellbore is repeated several times until the desired permeability of the formation is obtained. It is believed the increased permeability is a result of the relief of stress within the formation and the effects of the phenomenon of dilatancy. The phenomenon of dilatancy causes expansion of the matrix as the stress within the formation is reduced. This expansion of the matrix tends to be accompanied by an increase in the porosity and permeability of the matrix. Additionally, because the matrix of most formations is heterogeneous, any swelling which occurs as a result of fluid sorbing to the matrix will be uneven. The uneven swelling and uneven shrinking of the carbonaceous matrix that may occur within the formation as fluids are introduced and the wellbore is blown down will induce mechanical stresses and will promote shear failure within the formation.

The First Fluid

The first fluid can comprise any fluid which sorbs to the carbonaceous matrix of the solid carbonaceous subterranean formation. Preferably, cold liquid carbon dioxide is used. Carbon dioxide is preferred because it strongly sorbs to the carbonaceous matrix. The first fluid is injected into the solid carbonaceous subterranean formation and then is allowed to soak within the formation. The soak period is variable in length and may be short enough so that the introduction of the second fluid can commence as soon as the equipment is aligned to inject the second fluid into the formation. During the soak period, at least a portion of the first fluid sorbs to the carbonaceous matrix and may cause it to swell. As discussed earlier, uneven swelling and uneven shrinking of the matrix can promote failure within the formation. Additionally, the use of a first fluid, such as liquid carbon dioxide, especially if cold, will reduce the cohesion within the carbonaceous matrix. The cohesion of the carbonaceous matrix is the tendency of the matrix to stick together. If a large enough shear force is applied to the matrix, it will fail. The reduction in cohesion of the matrix by the first fluid will reduce the magnitude of the shear force required to cause failure within the carbonaceous matrix of the formation. This will make it easier to cause failure within the formation. A cold first fluid will also induce thermoelastic stresses which will promote failure within the matrix, especially if the first fluid is colder than the matrix and the second fluid is hotter than the matrix. Failure within the matrix, by whatever mechanism, will be accompanied by permeability enhancement within the formation.

The first fluid will fill up the pore spaces within the carbonaceous matrix as it sorbs to the carbonaceous matrix. When the pore spaces are filled with the sorbed fluid, the formation is not as easily damaged by fluids such gels. It may be advantageous to use high viscosity fluids such as forms or gels when it is desirable to introduce proppants into the formation. This is because these fluids .are viscous and able to better transport the proppant into the formation.

In addition to filling the pore spaces of the carbonaceous matrix, first fluids such as carbon dioxide, which are in a gaseous state within the formation, help to expel the second fluid from the formation. This is a result of the expansion of the gaseous first fluid within the formation as the pressure is relieved through the wellbore during blowdown. As the first fluid expands, it tends to push the second fluid away from the carbonaceous matrix. This will result in better cleanup of the formation with less chance of residues from the second fluid damaging the formation. Also, as the second fluid flows back toward the wellbore, shear forces are created within the formation which enhance the failure within the formation.

The Second Fluid

As discussed earlier, the second fluid is injected into the solid carbonaceous subterranean formation after the first fluid has soaked within the formation for a sufficient period of time. The second fluid should be injected at a pressure higher than the parting pressure of the formation.

It is believed that a violent and rapid pressurization and depressurization of the formation is important in obtaining the maximum stress relief within the carbonaceous matrix of the solid carbonaceous subterranean formation. Water, foams, or gels can be used to achieve the maximum stress relief within the formation. Water and other relatively incompressible fluids will allow pressure to be built up rapidly within the formation and to be rapidly released during blowdown. These fluids will also exert drag forces on the carbonaceous matrix during blowdown. The application of drag forces to the carbonaceous matrix during blowdown will further aid in the failure of the formation.

Gaseous fluids such as air, carbon dioxide, nitrogen, argon, hydrogen, methane, flue gas, helium or combinations thereof are preferably utilized as the second fluid in selected applications of the invention, such as where there is concern that the use of a liquid may damage the permeability of the formation.

In some situations, it may be advantageous to use only a single fluid to stimulate a formation. In this type of situation, the fluid is injected into the formation at a pressure greater than the parting pressure of the formation. The injection of fluid and the subsequent blowdown of the formation is repeated until a desired permeability is obtained within the formation. In this aspect of the invention it can be advantageous to inject a relatively cold fluid intermittently between injections of warmer fluid. Alternatively, the injection of colder and warmer fluids can be alternated. By alternating the cold and warmer fluid, thermoelastic stresses within the formation may be increased which will enhance the shear failure within the formation. It may be preferable to minimize the time between injection and blowdown cycles to maximize the thermoelastic stress differentials within the formation.

The methods for determining when to stop repeating the injection and blowdown steps with either a single fluid or multiple fluids are discussed more fully below.

Operation

Referring to FIG. 1, in a preferred embodiment of the invention, a first fluid, such as carbon dioxide, is introduced into a solid carbonaceous subterranean formation 11 through a wellbore 13. The portion of the wellbore 13 which penetrates the carbonaceous formation 15 may be cased or completed using an open-hole technique. If the well is completed using an open-hole technique, it can be advantageous to score the carbonaceous matrix in the region surrounding the wellbore prior to performing the method of the current invention. Alternatively, the walls of the open-hole interval can be cut to produce a square shape within the formation as viewed from above, or some other shape which will intensify the stresses acting on the open-hole interval. The focusing of the stresses acting on the open-hole interval which results from either scoring the walls or cutting them into a predetermined shape will assist in the failure of the carbonaceous matrix.

The first fluid may be injected below or above the parting pressure of the formation. In determining whether to inject the first fluid at a pressure above or below the parting pressure, it is important to consider what the second fluid will be and whether the associated stimulation technique is to be directed mainly to the wellbore area or to the formation in general. An example of a situation where it can be important to inject the first fluid at above the parting pressure is when a cross-linked gel is to be used for the second fluid. In this instance, the injection of the first fluid above the parting pressure of the formation will force the first fluid into the formation beyond the near wellbore region. The first fluid will fill up the pore spaces of the carbonaceous matrix beyond the wellbore region and should minimize any potential damage to the permeability of the formation caused by sorption of the second fluid to the matrix beyond the wellbore region.

It may be desirable to repeat the injection of first fluid, either intermittently, or alternatively, before each injection of second fluid. The introduction of first fluid more than once during the procedure may assist in the failure of the carbonaceous matrix, especially if a cold fluid, such as liquid carbon dioxide, is used as the first fluid. Also, injecting the first fluid into the formation more than once may help to minimize potential damage to the formation by second fluid.

Figure 2:
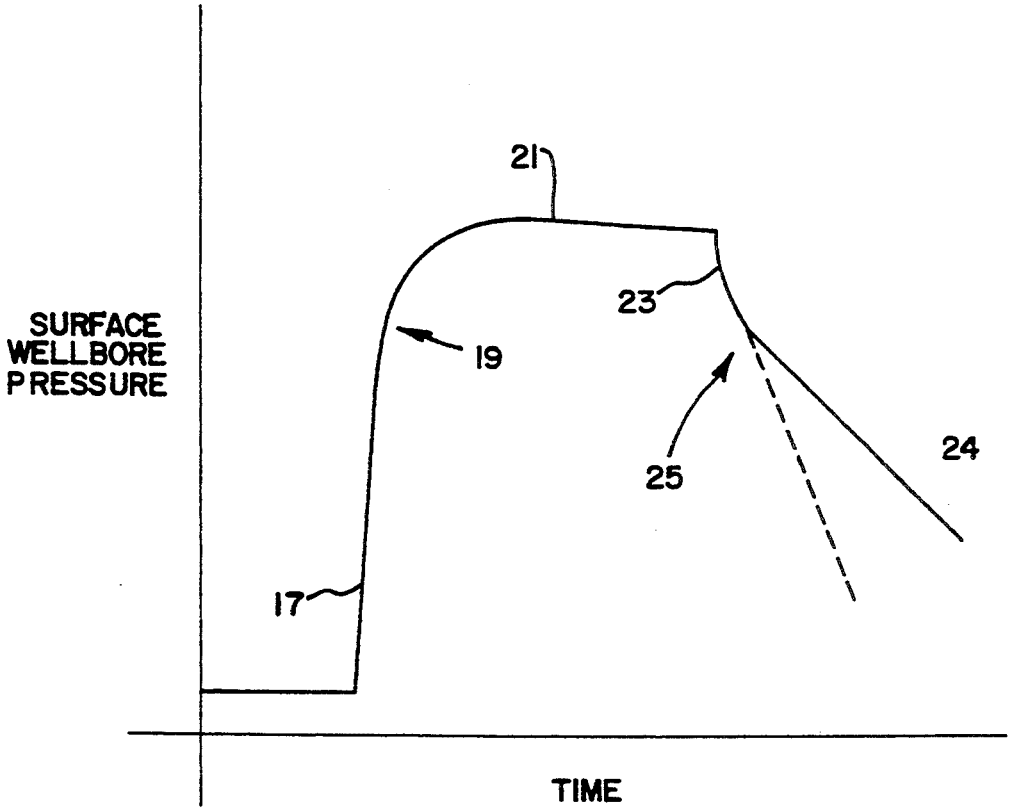
FIG. 2 is a graphical representation of the surface wellbore pressure versus time as a fluid is introduced into the formation, by injecting it through a wellbore at a pressure greater than the formation parting pressure. The graph also shows the change in the surface wellbore pressure as the wellbore is blown down.

Referring now to FIG. 2, illustrated is a plot of the surface wellbore pressure versus time during the introduction of a fluid into the formation at greater than the parting pressure of the formation. FIG. 2 displays the typical response of the wellbore to the introduction and blowdown of the second fluid, or first fluid, if only one fluid is used. The surface wellbore pressure is plotted because it is a readily measurable parameter and because it is equivalent to the wellbore pressure near the formation in our present invention. Line segment 17 shows the surface wellbore pressure increasing during initial filling and pressurization of the wellbore. The pressure within the wellbore increases until it reaches the parting pressure 19 of the formation. Induced fractures within the formation are extended after the pressure in the wellbore reaches the parting pressure 19 of the formation. During the extension of the fracture system, the wellbore pressure may remain approximately constant as shown by line segment 21 or it may decrease. It may be preferable to minimize the duration of each injection portion of the cycle after parting pressure has been exceeded in order to minimize the amount of fluid utilized.

After injection of the fluid has ceased, blowdown of the formation is initiated by rapidly relieving pressure within the formation by venting through the wellbore. As shown in FIG. 2, during the blowdown period, which includes segments 23 and 24, the surface wellbore pressure initially decreases at a rate depicted by segment 23 until the apparent closure pressure 25 of the formation is reached. The apparent closure pressure 25 is the pressure measured at the wellbore when the majority of the induced fractures have closed. The apparent closure pressure 25 is used because stress varies within the formation relative to the distance from the wellbore and because the closure pressure may not be the same for all points within the formation. As can be seen from FIG. 2, when the apparent closure pressure 25 is reached, the rate of change of surface wellbore pressure decreases. Segment 24 depicts the rate of change in the surface wellbore pressure after the apparent closure pressure 25 is reached. The exact rate of change of the pressure is not critical for the current invention. What is useful to the current invention is the understanding that it may be possible to determine the apparent closure pressure of the formation by an inspection of a plot of surface wellbore pressure versus time during blowdown.

As pressure is relieved and the fluids move towards the wellbore, the rapid release of pressure and the drag forces exerted on the carbonaceous matrix will cause failure within the carbonaceous matrix and the release of fines from the carbonaceous matrix into the wellbore region. It is preferable to relieve the pressure at the maximum rate attainable. The maximum rate attainable is the rate which results from flowing back the fluids through the wellbore and wellbore control equipment with no added flow restriction that is not required for safely practicing the invention. More preferably, the pressure within the formation is relieved from at least 100 to 1000 p.s.i. above the formation parting pressure to 200 to 600 p.s.i. below the reservoir pressure of the formation within about 15 minutes to one hour.

If the wellbore was completed using cased-hole techniques, new perforations should preferably be created in the casing near the formation prior to blowdown of the formation. A casing gun is preferably used when perforating the casing. Other alternatives techniques which may be used to perforate the casing include overbalanced perforating and/or the creation of slots in the casing by fluid jetting apparatus. The new holes created in the casing will aid in the removal of fines from the region surrounding the wellbore. The removal of the fines will assist in further failure of the formation and will reduce potential near wellbore permeability damage caused by fines. Fines which flow into the wellbore but are not removed to the surface during blowdown can be collected in a rathole which preferably is formed at the bottom of the wellbore. A pump can be installed in the rathole to aid in the removal of fines and fluids from the wellbore.

The rapid introduction of second fluid above the formation parting pressure and blowdown of the formation is repeated until the desired degree of failure within the formation is obtained. If a single fluid is used it is repeatedly introduced at a pressure above the formation parting pressure and the formation is repeatedly blown down through the wellbore.

Figure 3:
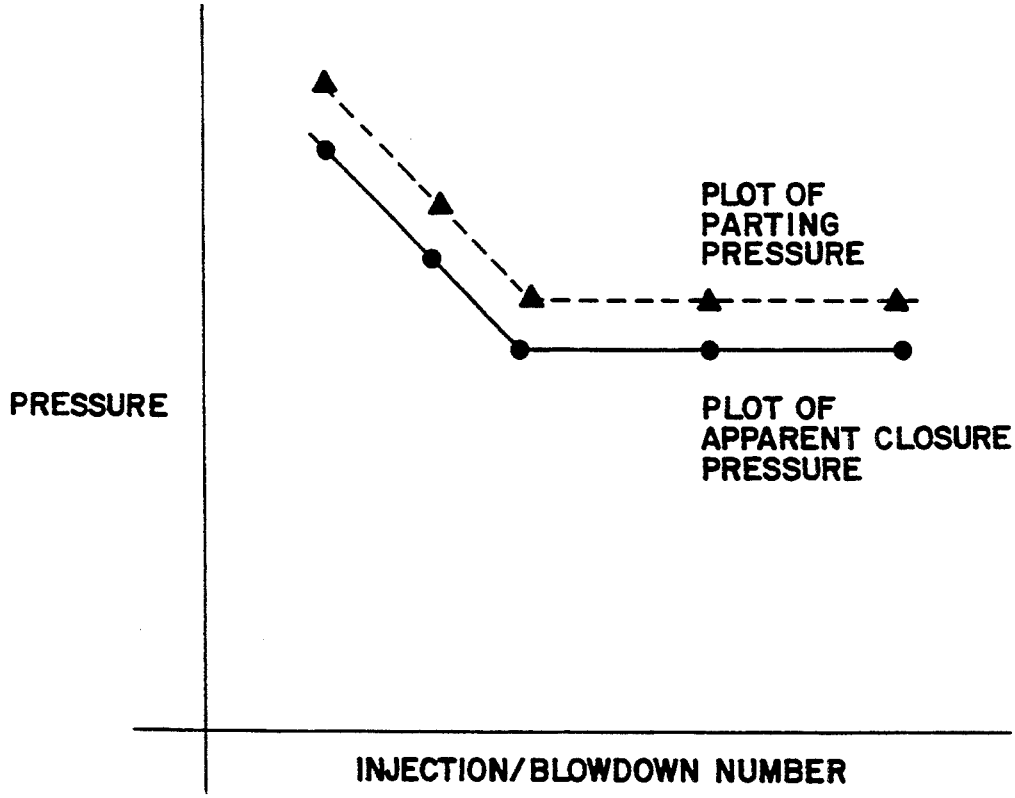
FIG. 3 is a graphical representation of the formation parting pressure versus injection/blowdown cycle number and the apparent closure pressure versus injection/blowdown cycle number.

In one aspect of the invention, the injection and blowdown are repeated until the amount of fines produced after the injection and blowdown cycle is reduced to near zero. In another aspect of the invention, parting pressure for each cycle is determined from a plot of surface wellbore pressure versus time for the pressurization portion of the cycle, such as depicted in FIG. 2. The parting pressures for each cycle are then plotted as depicted in FIG. 3. The parting pressure should decrease with every subsequent injection and blowdown cycle. While not wishing to be bound by any theory, it appears that this results because the parting pressure is proportional to the in situ stress within the solid carbonaceous subterranean formation. As the stress is relieved within the solid carbonaceous subterranean formation, the parting pressure will decrease. The injection and blowdown cycle should be repeated until the rate of change of the parting pressure from cycle to subsequent cycle does not economically justify further stimulation of the formation. Preferably, the injection and blowdown cycle should be repeated until a calculated rate of change of the parting pressure from the second to last introduction of fluid to the last introduction of fluid is less than one-half the calculated rate of change of the parting pressure from the third to the last introduction of fluid to the second to last introduction of fluid. More preferably, the injection and blowdown cycle should be repeated until the rate of change of the parting pressure from cycle to subsequent cycle approaches a value of near zero (i.e. the parting pressure approaches an approximately constant value on successive cycles.)

In a further aspect of the invention, the apparent closure pressure for each cycle is determined from a plot of surface pressure wellbore versus time for the blowdown portion of the cycle, such as depicted in FIG. 2. The apparent closure pressures for each cycle are then plotted as depicted in FIG. 3. The apparent closure pressure, like the parting pressure, should decrease with every subsequent injection and blowdown cycle. The cycle of injection and blowdown should be repeated until the rate of change of the apparent closure pressure from cycle to subsequent cycle does not economically justify further stimulation of the formation. Preferably, the injection and blowdown cycle should be repeated until a calculated rate of change of the apparent closure pressure from the second to last introduction of fluid to the last introduction of fluid is less than one-half the calculated rate of change of the apparent closure pressure from the third to the last introduction of fluid to the second to last introduction of fluid. More preferably, the injection and blowdown cycle should be repeated until the rate of change of the apparent closure pressure from cycle to subsequent cycle approaches a value of near zero (i.e. the apparent closure pressure approaches an approximately constant value on successive cycles.)

From the foregoing description, it can be observed that numerous variations, alternatives and modifications will be apparent to those skilled in the art. Accordingly, this description is to be construed as illustrative only and is for the purpose of teaching those skilled in the art the manner of carrying out the invention. Thus, it will be appreciated that various modifications, alternatives, variations, etc., may be made without departing from the spirit and scope of the invention as defined in the appended claims. It is, of course, intended that the appended claims cover all such modifications involved within the scope of the claims.

We claim:

1. A method for improving the recovery of methane from a solid carbonaceous subterranean formation penetrated by a wellbore, the method comprising the steps of:

a) introducing a first fluid into the solid carbonaceous subterranean formation which sorbs to the solid carbonaceous subterranean formation;

b) allowing at least a portion of the first fluid to sorb the solid carbonaceous subterranean formation;

c) introducing a chemically different second fluid into the solid carbonaceous subterranean formation at a pressure higher than the parting pressure of the solid carbonaceous subterranean formation;

d) relieving pressure within the solid carbonaceous subterranean formation to produce shear failure within the solid carbonaceous subterranean formation; and e) repeating steps c) through d) until a desired permeability of the solid carbonaceous subterranean formation is obtained.

2. The method of claim 1, further comprising the step of removing fines from the wellbore which were produced during step d).

3. The method of claim 2, wherein steps c) through d) are repeated until the amount of fines produced decreases to substantially zero.

4. The method of claim 1, wherein the first fluid is selected from the group consisting of carbon dioxide, xenon, argon, neon, hydrogen sulfide, ammonia, methane, ethane, propane, butane, air, hydrogen, carbon monoxide, nitrogen, flue gas and combinations thereof.

5. The method of claim 4, wherein the second fluid is selected from the group consisting of nitrogen, carbon dioxide, air, methane, flue gas, and combinations thereof.

6. The method of claim 4, wherein the second fluid is selected from the group consisting of water, foamed water, cross-linked gel, foam, foamed cross-linked gel, foamed linear gel and combinations thereof.

7. The method of claim 6, further comprising repeating steps a) through b).

8. The method of claim 7, wherein steps a) through b) are repeated every time steps c) through d) are repeated.

9. The method of claim 6, wherein the first fluid is injected at a pressure higher than the parting pressure of the solid carbonaceous subterranean formation.

10. The method of claim 1, wherein the pressure relieved in step d) is relieved from at least about 100 to 1000 p.s.i. above the parting pressure of the formation to about 200 to 600 p.s.i. below a reservoir pressure of the formation within 15 minutes to one hour.

11. The method of claim 1, wherein the second fluid is selected from the group including water, foamed water, cross-linked gel, foam, foamed cross-linked gels, foamed linear gel, and combinations thereof.

12. The method of claim 1, wherein the second fluid is selected from the group consisting of nitrogen, carbon dioxide, air, methane, flue gas, and combinations thereof.

13. The method of claim 1, wherein the first fluid is injected at a pressure higher than the parting pressure of the solid carbonaceous subterranean formation.

14. The method of claim 1 further comprising repeating steps a) and b).

15. The method of claim 1, wherein the solid carbonaceous subterranean formation comprises a coalbed.

16. The method of claim 1, wherein a section of the wellbore which penetrates the formation forms an open-hole interval which has walls cut into a shape which will intensify the stresses acting on the open-hole interval.

17. The method of claim 1, further comprising:

f) recovering methane from the formation through the wellbore.

18. A method for improving the recovery of methane from a solid carbonaceous subterranean formation penetrated by a wellbore, the method comprising the steps of:

a) introducing a fluid into the solid carbonaceous subterranean formation which sorbs to the solid carbonaceous subterranean formation at a pressure above the parting pressure of the formation;

b) relieving pressure within the solid carbonaceous subterranean formation to produce shear failure within the solid carbonaceous subterranean formation; and c) repeating steps a) through b) at least until a calculated rate of change of the Darting pressure from the second to last introduction of fluid to the last introduction of fluid is less than one half the calculated rate of change of the parting pressure from the third to last introduction of fluid to the second to last introduction of fluid.

19. The method of claim 18, wherein steps a) through b) are repeated until a rate of change of the parting pressure from cycle to subsequent cycle approaches a value of near zero.

20. The method of claim 18, wherein the fluid is selected from the group consisting of nitrogen, carbon dioxide, methane, carbon monoxide, hydrogen, flue gas and mixtures thereof.

21. The method of claim 18, wherein the introduced fluid is maintained in the solid carbonaceous subterranean formation to enhance the sorption of the fluid to a carbonaceous matrix of the formation.

22. The method of claim 18, wherein the fluid comprises at least about 80% by volume nitrogen.

23. The method of claim 18, wherein the fluid comprises at least about 80% by volume carbon dioxide.

24. The method of claim 18, wherein the fluid comprises at least 5% by volume methane.

25. The method of claim 18, wherein the wellbore has wellbore control equipment and the pressure is relieved at a rate essentially equivalent to a maximum flow rate permitted by the wellbore and wellbore control equipment.

26. The method of claim 18, wherein the pressure relieved in step b) is relieved from at least about 100 to 1000 p.s.i. above the parting pressure of the formation to about 200 to 600 p.s.i. below a reservoir pressure of the formation within 15 minutes to one hour.

27. The method of claim 18, further comprising introducing a second fluid into the formation at a pressure below the parting pressure of the formation.

28. The method of claim 27, wherein the second fluid comprises carbon dioxide and the fluid introduced above the parting pressure comprises nitrogen.

29. The method of claim 18, wherein the solid carbonaceous subterranean formation comprises a coalbed.

30. The method of claim 18, wherein a section of the wellbore which penetrates the solid carbonaceous subterranean formation is completed using a cased-hole technique.

31. The method of claim 18, further comprising:

d) recovering methane from the formation through the wellbore.

32. A method for improving the recovery of methane from a solid carbonaceous subterranean formation penetrated by a wellbore having wellbore control equipment, capable of regulating the rate of fluid flow from the wellbore, the method comprising the steps of:

a) introducing a fluid into the solid carbonaceous subterranean formation which sorbs to the solid carbonaceous subterranean formation at a pressure above the parting pressure of the formation;

b) relieving pressure within the solid carbonaceous subterranean formation to produce shear failure within the solid carbonaceous subterranean formation; and c) repeating steps a) through b) at least until a calculated rate of change of the apparent closure pressure from the second to introduction of fluid to the last introduction of fluid is less than one half the calculated rate of change of the apparent closure pressure from the third to last introduction of fluid to the second to last introduction of fluid.

33. The method of claim 32, wherein steps a) through b) are repeated until a rate of change of the apparent closure pressure from cycle to subsequent cycle approaches a value of near zero.

34. The method of claim 32, wherein the fluid comprises at least 80% by volume nitrogen.

35. The method of claim 32, wherein the pressure is relieved at a rate essentially equivalent to a maximum flow rate permitted by the wellbore and wellbore control equipment.

36. The method of claim 32, wherein the pressure relieved in step b) is relieved from at least about 100 to 1000 p.s.i. above the parting pressure of the formation to about 200 to 600 p.s.i. below a reservoir pressure of the formation within 15 minutes to one hour.

37. The method of claim 32, wherein a section of the wellbore which penetrates the solid carbonaceous subterranean formation is completed using a cased-hole technique.

38. The method of claim 32, wherein the fluid introduced above the parting pressure comprises at least 80% by volume nitrogen and the method further comprises:

d) introducing a second fluid, comprising carbon dioxide, into the formation at a pressure below the parting pressure of the formation.

39. The method of claim 32, further comprising:

d) recovering methane from the formation through the wellbore.

* * * * *

UNITED STATES PATENT AND TRADEMARK OFFICE
CERTIFICATE OF CORRECTION

PATENT NO.: 5,417,286

DATED: May 23, 1995

INVENTOR(S): Ian D. Palmer, Dan Yee

It is certified that error appears in the above-identified patent and that said Letters Patent is hereby corrected as shown below:

| Col. | Line | |
|---|---|---|
| 11 | 43 | "rate of change of the Darting pressure" should read --rate of change of the parting pressure-- |
| 12 | 35 | "from the second to introduction of fluid" should read --from the second to last introduction of fluid-- |

Signed and Sealed this

Twenty-second Day of April, 1997

Bruce Lehman

BRUCE LEHMAN

*Commissioner of Patents and Trademarks*

*Attest:*

*Attesting Officer*